US006473687B2

(12) United States Patent
Ando

(10) Patent No.: US 6,473,687 B2
(45) Date of Patent: Oct. 29, 2002

(54) ENGINE CONTROL UNIT OPERABLE WITH DIFFERENT CLOCKS BASED ON CRANK SIGNAL SYSTEM OPERATION

(75) Inventor: Katsuyuki Ando, Kasugai (JP)

(73) Assignee: Denso Corporation, Aichi (JP)

( * ) Notice: Subject to any disclaimer, the term of this patent is extended or adjusted under 35 U.S.C. 154(b) by 8 days.

(21) Appl. No.: 09/768,495

(22) Filed: Jan. 25, 2001

(65) Prior Publication Data

US 2001/0011206 A1 Aug. 2, 2001

(30) Foreign Application Priority Data

Jan. 27, 2000 (JP) ..... 2000-019302
Dec. 20, 2000 (JP) ..... 2000-387270

(51) Int. Cl.[7] ..... F02D 41/22; F02P 11/00
(52) U.S. Cl. ..... 701/114; 123/406.18; 123/479
(58) Field of Search ..... 123/406.58, 406.62, 123/487, 612, 613, 617, 479, 106.18; 701/102, 114, 115; 73/116, 118.1

(56) References Cited

U.S. PATENT DOCUMENTS 4,782,692 A * 11/1988 Peden et al. ..... 73/117.3

* cited by examiner

*Primary Examiner*—Andrew M. Dolinar
*Assistant Examiner*—Johnny H. Hoang
(74) *Attorney, Agent, or Firm*—Nixon & Vanderhye PC

(57) ABSTRACT

An engine control unit receives a crank signal that includes a pulse train of a predetermined angle interval corresponding to rotation of an engine crankshaft. An edge time measuring counter measures a pulse interval. A frequency multiplication counter generates frequency multiplication clocks of an integer times the next pulse on the basis of the pulse interval of this time. An angle counter for ignition and/or injection operates on the basis of the frequency multiplication clocks. When a failure in a crank signal system is detected, a CPU switches the angle counter by a change-over switch so as to be used as a free-run counter which operates on the basis of time clocks, and generates a control signal for controlling the engine in accordance with the value of the free-run counter.

10 Claims, 10 Drawing Sheets

ENGINE CONTROL UNIT OPERABLE WITH DIFFERENT CLOCKS BASED ON CRANK SIGNAL SYSTEM OPERATION

CROSS REFERENCE TO RELATED APPLICATION

This application is based on and incorporates herein by reference Japanese Patent Applications No. 2000-19302 filed Jan. 27, 2000 and No. 2000-387270 filed Dec. 20, 2000.

BACKGROUND OF THE INVENTION

The present invention relates to an engine control unit, and particularly to an engine control unit which changes input clocks depending on presence/absence of failure in a crank signal system.

An engine control unit (ECU) is an electronic control unit for performing controls such as fuel injection control, ignition control, and idle speed control to operate an engine in an optimum state. Specifically, signals from various sensors for sensing engine operating states such as crank angle and engine coolant temperature are supplied to the ECU to control an optimum fuel injection amount, injection timing, ignition timing, and the like.

Controls synchronized with the engine speed such as ignition control and injection control, that is, controls synchronized with a crankshaft rotation position, are performed by generating a signal of ignition pulses or the like after elapse of offset (delay) time from a predetermined crankshaft rotation position indicated by the edge of a crank signal.

It is, however, necessary to perform an arithmetic operation for converting the angle to time. There is a demand for reduction in processing load and improvement in accuracy.

SUMMARY OF THE INVENTION

It is therefore an object of the present invention to provide an engine control unit with reduced processing load and improved accuracy and, moreover, capable of properly controlling the engine even when a crank signal system fails to generate crank signals properly.

According to the present invention, a crank signal of a pulse train of a predetermined angle interval corresponding to rotation of a crankshaft of an engine is generated and its pulse interval is measured. Frequency multiplication signals of integer times of the crank signal are generated as angle clocks by using the measured pulse interval. The angle clocks are used to determine a time point of fuel injection and/or ignition events of the engine as long as a crank signal system supplies the crank signal properly. When a failure in the crank signal system is detected, time clocks are used in place of the angle clocks to determine the time point of fuel injection and/or ignition events.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENT

The present invention will be described in detail with reference to an embodiment, in which an engine control unit (ECU) is applied to a five-cylinder (#1–#5) four-cycle engine.

Figure 1:
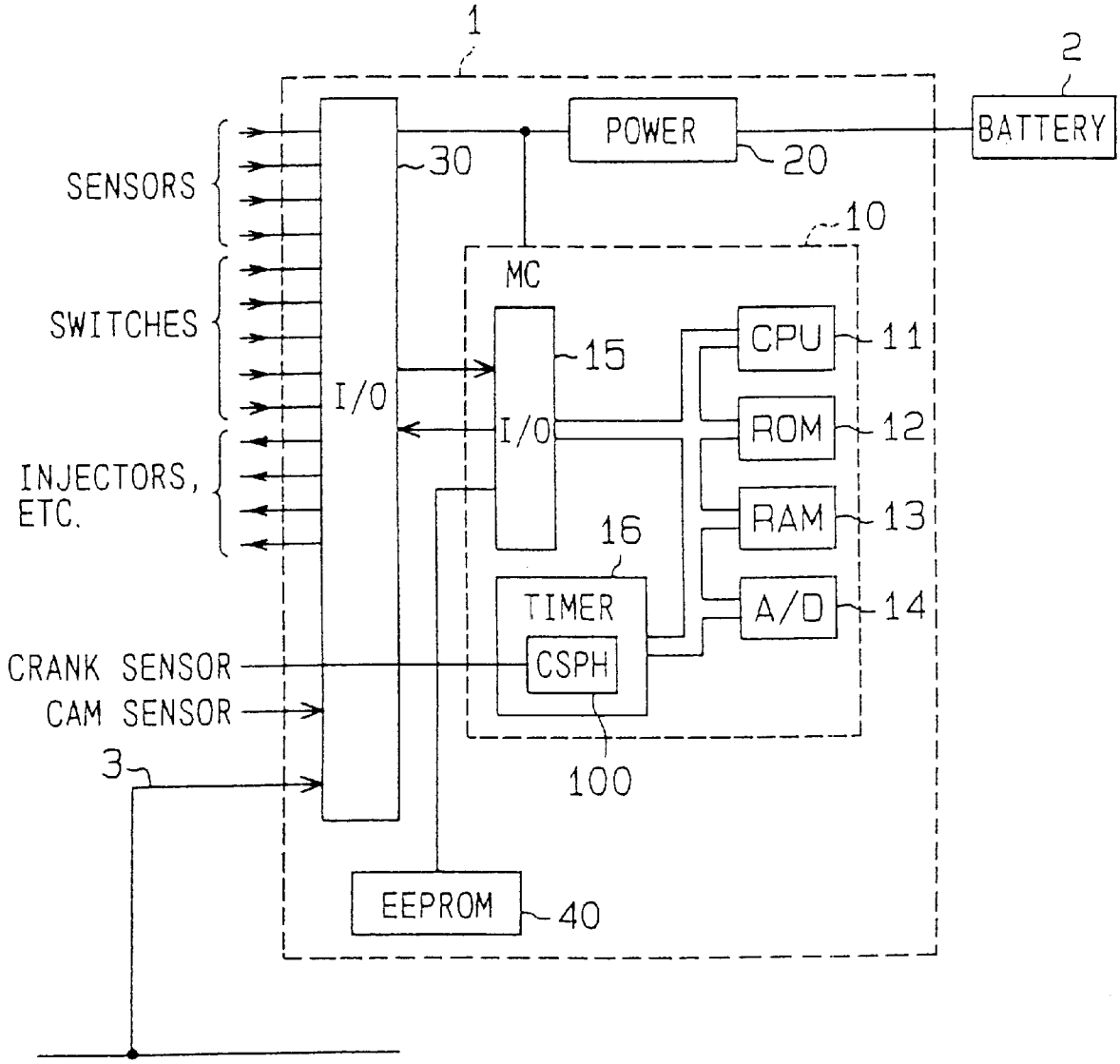
FIG. 1 is a block diagram showing an engine control unit (ECU) according to an embodiment of the present invention.

Referring to FIG. 1, an engine control unit (ECU) 1 has a microcomputer (MC) 10, a power supply circuit 20, an input/output circuit (I/O) 30, and an EEPROM 40. The power supply circuit 20 receives a supply of power from a battery 2 and supplies a predetermined voltage to various electronic circuit devices in the ECU 1. The microcomputer 10 has a CPU 11, a ROM 12, a RAM 13, an A/D converter 14, an input/output interface 15, and a timer module 16. The circuit devices transmit/receive data to/from each other via a data bus. The EEPROM 40 is connected to the input/output interface 15, and the circuit devices transmit/receive data to/from the EEPROM 40 via the input/output interface 15.

The input/output circuit 30 receives signals from sensors, switches, and the like, and outputs drive signals to injectors (fuel injection valves) and an igniter. Further, a communication line 3 is connected to the input/output circuit 30 and data is transmitted/received to/from other ECUs (not shown) via the input/output circuit 30. The CPU 11 in the microcomputer 10 receives signals (data) from the sensors, switches, and the like and data from the communication line 3 via the input/output circuit 30 and the input/output interface 15 and executes various arithmetic operations on the basis of the data to control the injectors and the like via the input/output interface 15 and the input/output circuit 30.

Figure 2:
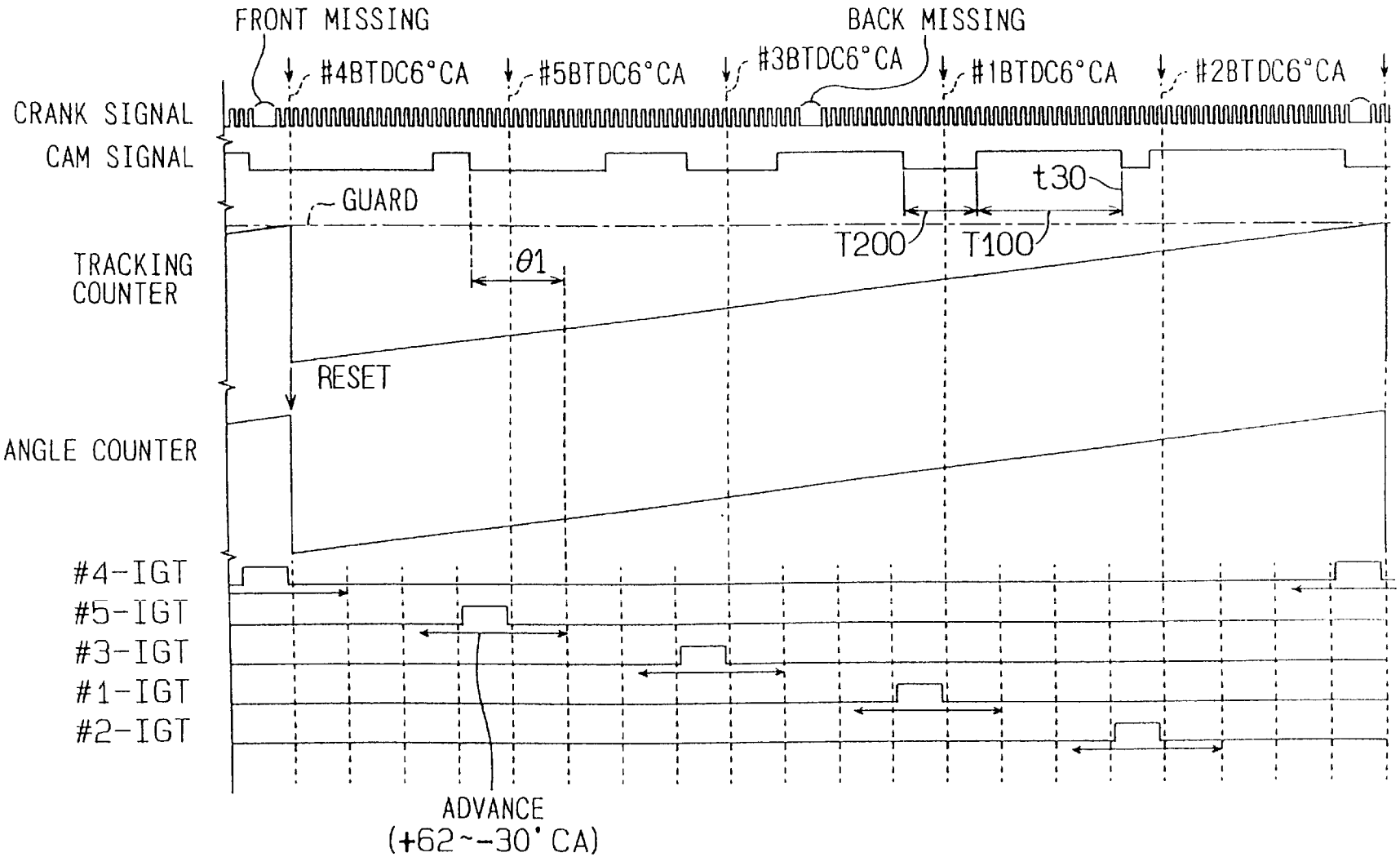
FIG. 2 is a time chart of ignition in one cycle (720* CA) of an engine in the embodiment.

The signals received by the ECU 1 include a crank signal from a crank angle sensor and a cam signal from a cam angle sensor. FIG. 2 shows the crank signal and the cam signal of one cycle (720* crank angle) of the engine.

The crank signal generated by the crank angle sensor is a pulse train of every predetermined angle interval corresponding to rotation of the crankshaft of the four-cycle engine. The crank signal has a pulse missing portion (reference position in rotation of the crankshaft) in which pulses are missing in the pulse train to indicate the reference position of the crankshaft based on which delay angles of starting fuel injection and ignition are measured. In the crank signal in the embodiment, two pulses are skipped every 60 pulses so that the pulse train has 58 pulses in 360* CA). Specifically, the pulse interval in the pulse train is 6* CA, and the pulse missing portion is provided every 360* CA in the pulse train. One (pulse missing portion of every 720* CA) of the pulse missing portions is defined as a front pulse missing portion and the other one (pulse missing portion of every 720* CA subsequent to the first one) is defined as a back pulse missing portion.

The cam signal generated by the cam angle sensor is synchronized with the rotation of the camshaft of the engine and is a cylinder determination signal for specifying the cylinder position. The trailing edge of the cam signal is provided every 144* CA due to five-cylinder construction of the engine. At the trailing edge immediately after the front pulse missing portion of the crank signal, the cam signal is at the low (L) level. At the trailing edge immediately after the back pulse missing portion of the crank signal, the cam signal is at the high (H) level. That is, when the cam signal level is the L level in the pulse missing portion, the pulse missing portion can be determined as a front pulse missing portion. When the cam signal level is the H level in the pulse missing portion, the pulse missing portion can be determined as a back pulse missing portion.

The crank signal is supplied to a crank signal processing hardware (CSPH) 100 in the timer module 16 in FIG. 1. The cam signal is received by the microcomputer 10 via the input/output circuit 30. The crank signal processing hardware 100 provided in the timer module 16 is a functional unit for processing the crank signal in a hardware manner. A process on the crank signal (generation of angle signals by dividing crank edge interval) of FIG. 2 can be performed by the crank signal processing hardware 100 in a hardware manner.

Figure 3:
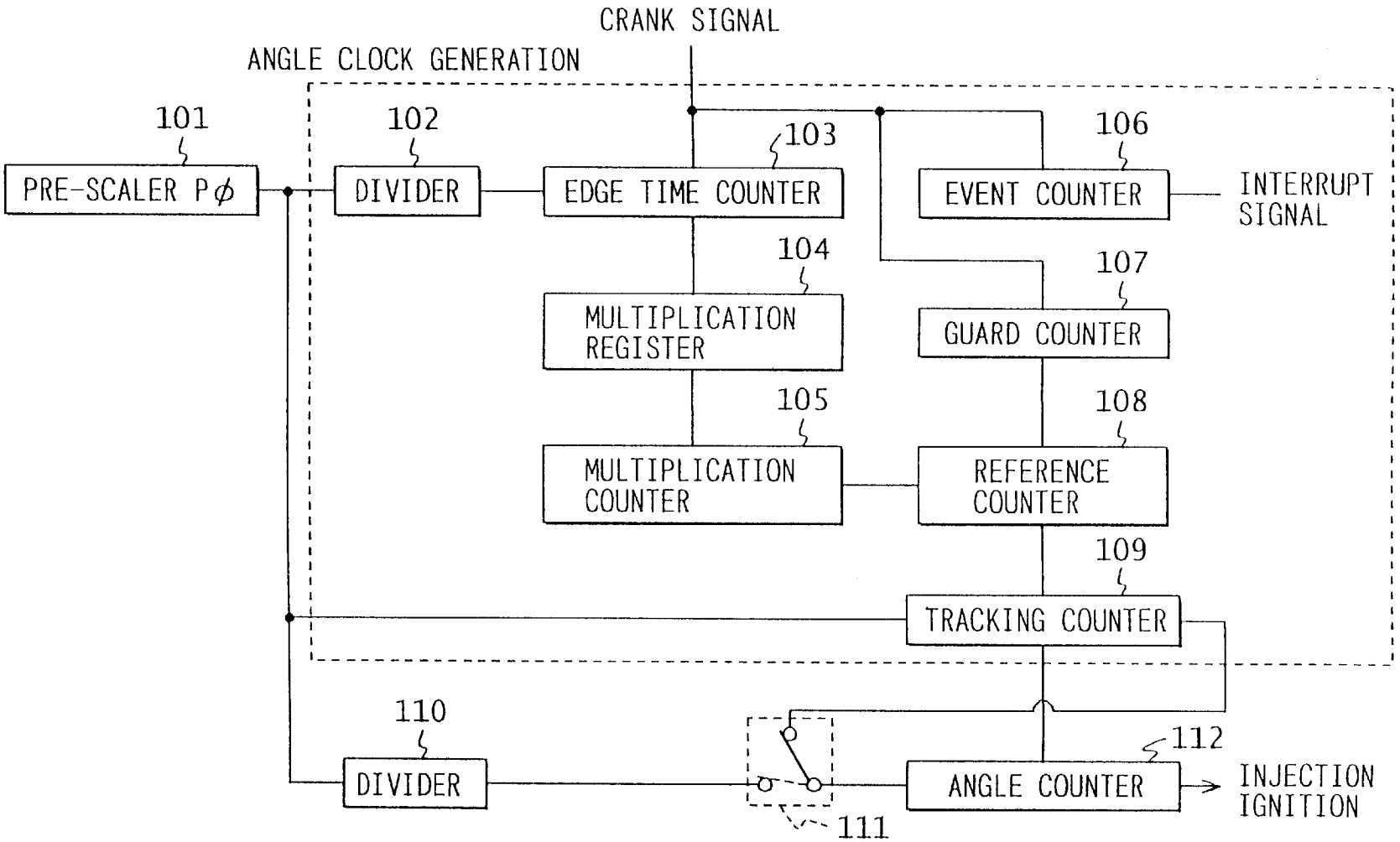
FIG. 3 is a circuit diagram showing a crank signal processing hardware used in the embodiment.

As shown in FIG. 3, the crank signal processing hardware 100 has a pre-scaler 101, a frequency divider 102, an edge time measuring counter 103, a frequency multiplication register (edge time storing register) 104, a frequency multiplication counter 105, an event counter 106, a guard counter 107, a reference counter 108, a tracking counter (angle counter) 109, and an angle clock counter 112 for generating injection signals and ignition signals. A signal P. from the pre-scaler 101 is sent to the edge time measuring counter 103 via the frequency divider 102. The signal P. is also sent to the tracking counter (angle counter) 109. The crank signal is sent to the edge time measuring counter 103, event counter 106, and guard counter 107.

Figure 4:
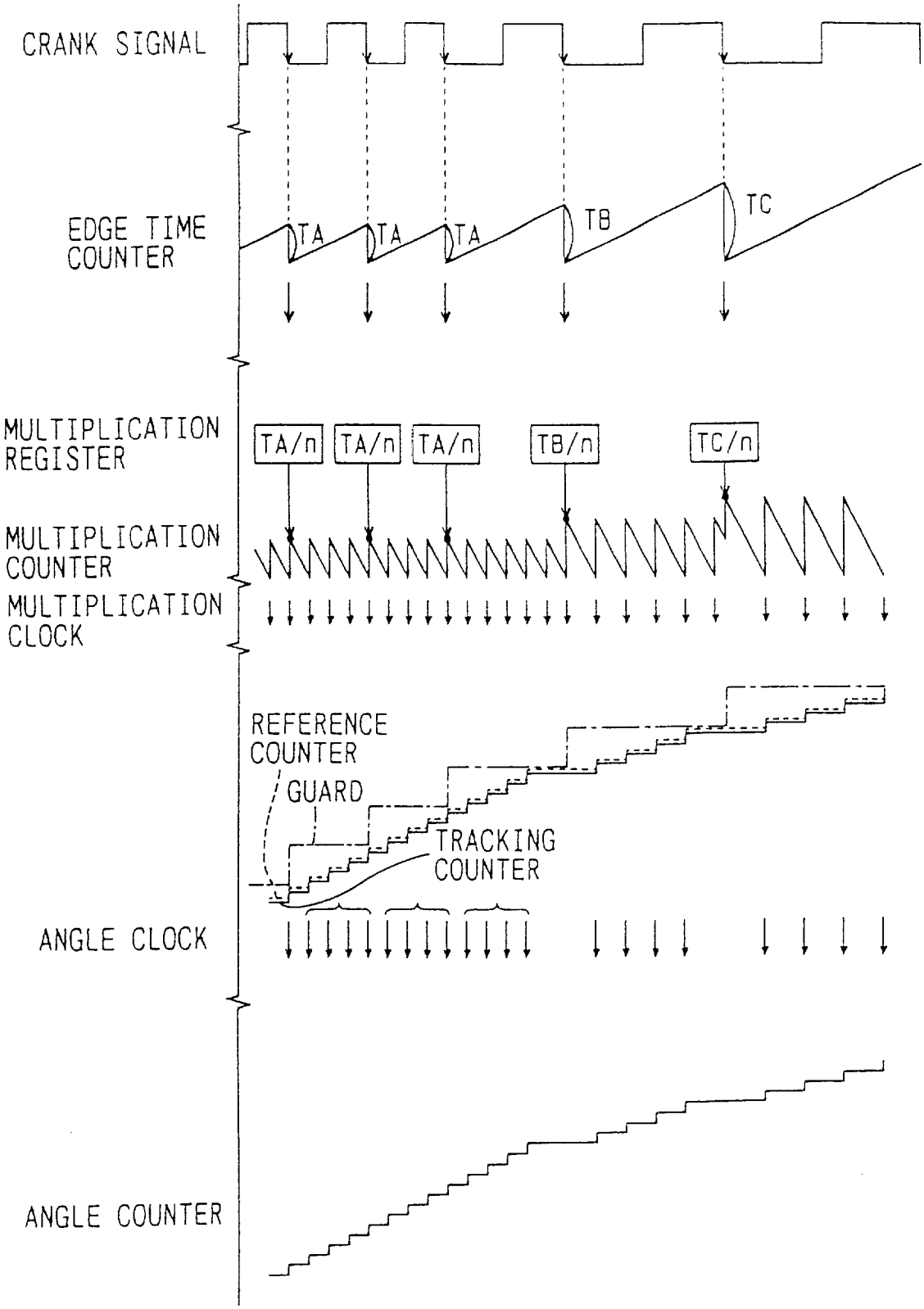
FIG. 4 is a time chart showing various signals including angle clocks generated by the crank signal processing hardware in the embodiment.

FIG. 4 is a time chart showing generation of angle clocks (angle signals). Shown in FIG. 4 are the input crank signal, the count value of the edge time measuring counter 103, a storage value of the frequency multiplication register 104, a count value of the frequency multiplication counter 105, an output signal (frequency multiplication clock) of the multiplication counter 105, a guard value (dot-chain line) which is (n) times as large as the value of the guard counter 107, a count value (dotted line) of the reference counter 108, a count value (solid line) of the tracking counter 109, and a count value of the angle counter 112.

The edge time measuring counter 103 in FIG. 3 receives the crank signal and measures the time between crank signal edges (pulse interval). More specifically, the edge time measuring counter 103 as pulse interval measuring means is a counter which is incremented by time synchronization as shown in FIG. 4 and measures time TA between crank edges (between trailing edges of the crank signal). The measured value is multiplied by 1/n times and resultant data is transferred to the frequency multiplication register 104 at the time of input of the crank edge. The transferred data serves as an initial value of the frequency multiplication counter 105 as a down-counter. An example of the frequency multiplication value (n) is "32".

The frequency multiplication counter 105 in FIG. 3 generates frequency multiplication clocks by multiplying the crank edge interval measured by the edge time measuring counter 103 by 1/n. Specifically, the frequency multiplication counter 105 counts down by time synchronization as shown in FIG. 4. When underflow occurs, it generates a frequency multiplication clock, and the count value is reset to the initial value TA/n. This operation is repeated. When the next crank edge (trailing edge of the crank signal) is supplied, the value of the frequency multiplication register 104 and the initial value of the frequency multiplication counter 105 are updated to the latest values. The frequency multiplication counter 105 as frequency multiplication signal generating means generates the frequency multiplication signals (frequency multiplication clocks) of an integer times the next pulse on the basis of the pulse interval, at this time, measured by the edge time measuring counter 103.

The reference counter 108 in FIG. 3 is incremented by the frequency multiplication clock as shown by the dotted line in FIG. 4. The tracking counter 109 in FIG. 3 is incremented by a time synchronization clock (performs a counting operation by the internal clock). The guard counter 107 is a counter for receiving the crank signal and is incremented by the trailing edge of the crank signal. On receipt of a crank edge, a value which is (n) times (frequency multiplication) as large as a value before the increment is transferred to the reference counter 108.

As shown in FIG. 4, the count value of the reference counter 108 cannot exceed the guard value (value of (n) times as large as the count value) transferred from the guard counter 107 when the crank edge is supplied. The guard value is shown by the dot-chain line in FIG. 4. The tracking counter 109 is incremented only when its value is smaller than the count value of the reference counter 108. Synchronously with the increment of the tracking counter 109, an angle clock (angle signal) is generated. In such a manner, the angle clock is generated by the three counters 107, 108 and 109.

In this embodiment, the internal clock (signal P. from the pre-scaler) is set to 20 MHz, and the tracking counter 109 can operate at higher speed as compared with the other counters.

In FIG. 4, at the time of engine deceleration in which the crank edge interval increases with time as shown by TB and TC, in the counting operations of the reference counter 108 and the tracking counter 109, the value of the reference counter 108 reaches the guard value which is (n) times as large as the value of the guard counter 107 before the crank edge is supplied, so that the increment of the tracking counter 109 is inhibited. The incrementing operation of the reference counter 108 and the tracking counter 109 is stopped at a frequency multiplication value by the guard counter 107. As a result, at the time of engine deceleration, the incrementing operation of the tracking counter 109 is stopped to prevent generation of angle clocks of a predetermined number or larger.

The angle counter 112 for ignition/injection in FIG. 3 is incremented as shown in FIG. 4, each time the angle clock from the tracking counter 109 is received. The ignition/injection controls are performed synchronously with the crank angles by using a comparison register on the basis of the count value of the angle counter 112 for ignition/injection. That is, the controls on ignition, injection, and the like are performed synchronously with the crank angle by the angle counter 112 for ignition/injection in a hardware manner. By realizing a system which generates frequency multiplication signals (frequency multiplication clocks) at predetermined angle intervals to synchronize with the engine speed, an arithmetic operation for converting from angle to time is made unnecessary. The reduction in processing load and improvement in accuracy (when n=32, LSB=0.1875* CA) can be achieved.

In FIG. 2, the front pulse missing portion is a system initialization position (angle). This initialization position is set to BTDC 6* CA of the fourth (#4) cylinder. When the count value of the tracking counter 109 is initialized at this initialization position, a reset signal is applied to the angle counter 112 for injection and ignition so that the angle counter 112 is initialized and synchronized with rotation of the crankshaft.

The event counter 106 in FIG. 3 increments at the trailing edges of pulses of the crank signal and outputs an angle cycle interrupt signal at each edge. The CPU 11 detects the pulse missing position in the crank signal from the count value (the number of edge inputs) of the event counter 106. The count value of the event counter 106 is initialized every engine cycle (720* CA).

Figure 5:
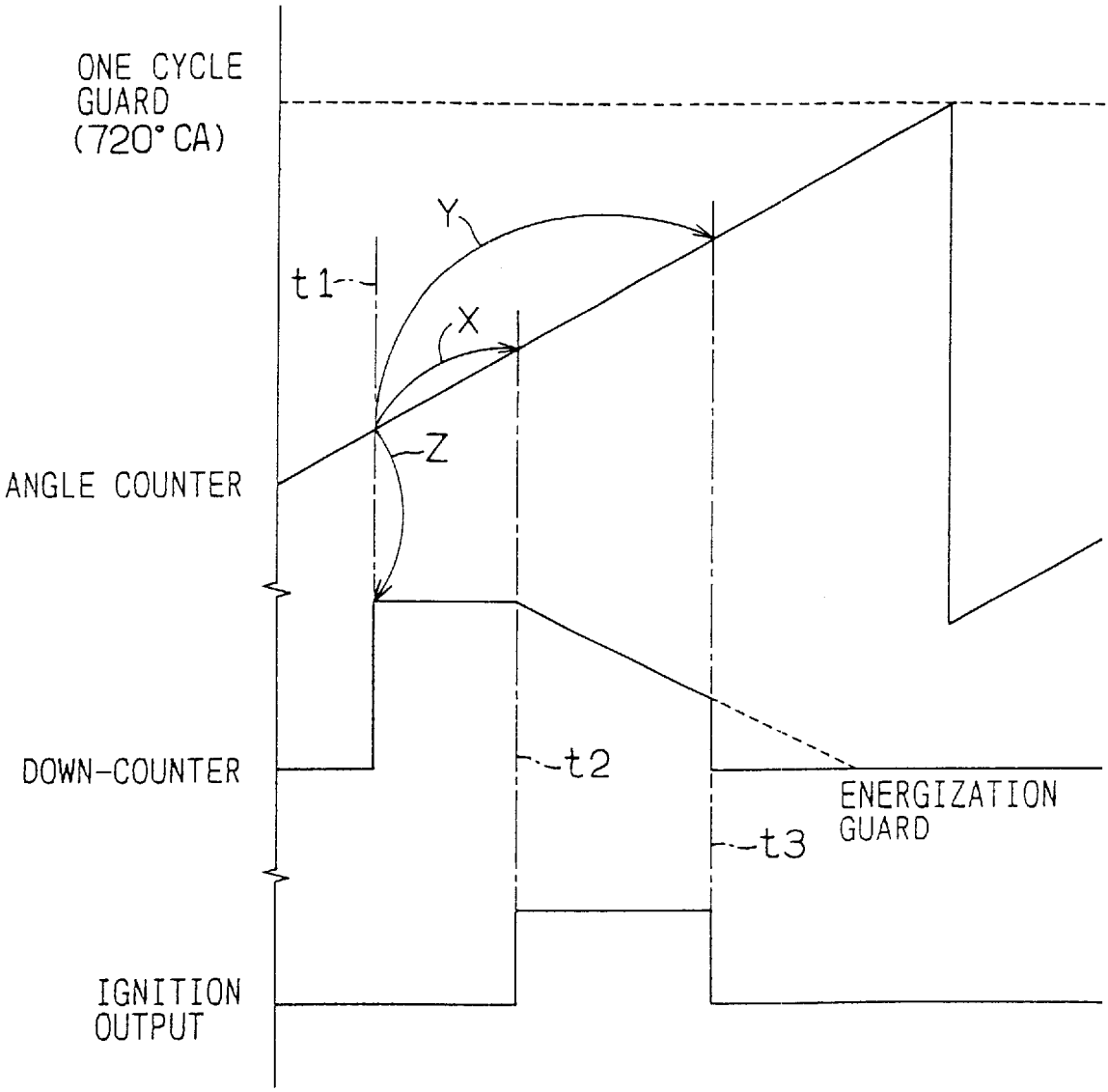
FIG. 5 is a time chart showing operations of an angle counter and a down-counter in the embodiment.

FIG. 5 is a time chart for controlling ignition/injection outputs by the angle counter 112 for ignition/injection when the crank signal system is normal.

First, by a predetermined 36* CA cycle interrupt shown by t1 in FIG. 5, energization start timing t2, ignition timing t3, and an energization guard value are set. Specifically, at timing before the desired timing of controlling an ignition output by predetermined angles (by the 36* CA cycle interrupt), absolute values X and Y in 720* CA of the energization start timing t2 and the ignition timing t3 calculated by the CPU 11 are set in an energization start timing setting register (not shown) and an ignition timing setting register (not shown), respectively. Further, as an initial value of a down-counter, the energization guard value Z is set. When the value of the angle timer (angle counter 112) and the value X of the energization start timing setting register coincide with each other (timing t2 in FIG. 5), the down-counter starts, the ignition output port is turned on, and energization of ignition coil is started.

After that, at timing t3 in FIG. 5, when the value of the angle timer (angle counter 112) coincides with the value Y of the ignition timing setting register, the down-counter is reset to "0", the ignition output port is turned off, and ignition is carried out. When the ignition timing value is set to be larger than the energization guard value Z, by the reset of the down-counter to "0", the ignition output port is turned off.

It may occur that a short circuit or the like occurs in the system for generating the crank signal (crank signal system). In this instance, in the above system which generates the angle clocks from crank edge input timings, as shown in the time chart of FIG. 11, the counting operation of the reference counter 108 and the tracking counter 109 is stopped by the guard counter 107, transmission of the angle clocks is stopped, and the angle timer (angle counter 112 for ignition/injection) is stopped. Consequently, the ignition/injection output is stopped and the engine control system is stopped. Even when the guard counter 107 does not stop the counting operation, the count value is reset as shown in FIG. 2 when the count value of the tracking counter 109 reaches the guard value of one cycle. Thus, the reset signal is sent to the angle counter 112 for ignition/injection. Consequently, the operation is stopped after one cycle (720* CA). After 720* CA since a failure such as short circuit in the crank signal system occurs, similarly, the angle timer 112 stops and the ignition/injection output is stopped.

Figure 11:
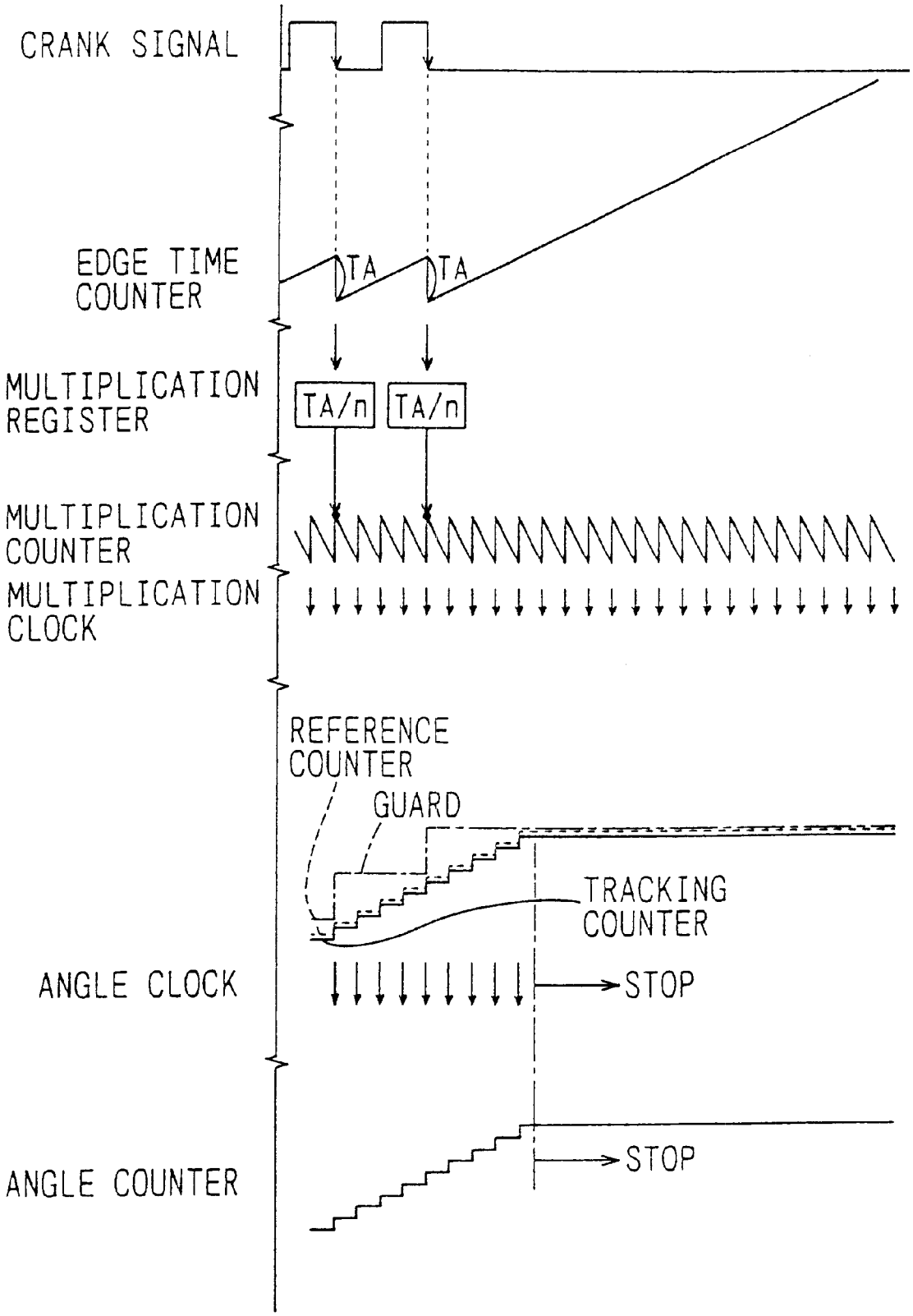
FIG. 11 is a time chart showing various signals including angle clocks generated by the crank signal processing hardware when a short circuit or the like occurs in the crank signal system.

As described above, when a short circuit or the like occurs in the crank signal system as shown in FIG. 11, no pulse of the crank signal is supplied, so that the angle clocks between the crank edges cannot be generated. Consequently, the angle timer (angle counter 112 for ignition/injection) stops, and the ignition/injection output and the like controlled by the angle timer cannot be controlled. In the case such that a pulse is missed in a crankshaft rotor, due to a change in the number of pulses of the crank signal or erroneous determination of the reference position in the crank signal, the angle timer becomes erroneous and the control on the ignition/injection output and the like cannot be normally performed. When the ignition/injection control cannot be accurately performed, the engine control cannot be normally continued after that, and the engine stops.

In order to prevent this, the following can be considered. A crank signal input process using a pseudo crank signal is preliminarily programmed and the program is stored in an integrated circuit or ROM for backup. When the crank signal system is faulty, the system is switched to the program or to an output port using an angle reference signal other than the crank signal as a reference. However, the above methods require dedicated circuit, integrated circuit, and input/output port.

In this embodiment, therefore, even when a fault such as short circuit occurs in the crank signal system, in order to make the engine control system continuously operate, the ignition/injection output is controlled by using the cam signal which is an angle reference signal other than the crank signal as a reference.

The configuration for this purpose will be described in detail hereinbelow.

As shown in FIG. 3, a change-over (selector) switch 111 is provided at the front stage of the angle counter 112 for ignition/injection. The angle clocks are supplied to the angle counter 112 for ignition/injection via the change-over switch 111. The signal Pϕ from the pre-scaler 101 is converted to a time clock by a frequency dividing circuit 110, and the time clock can be supplied to the angle counter 112 for ignition/injection via the change-over switch 111. Consequently, the angle clock and the time clock can be selected by the change-over switch 111 in FIG. 3. Either the angle clock or the time clock is sent to the angle counter 112 for ignition/injection. The change-over switch 111 is switched by the CPU 11.

A fail process is performed as follows. When a failure such as short circuit in the crank signal system is detected, a flag indicative of a crank signal system failure is set. The angle counter 112 for ignition/injection in FIG. 3 can select either the angle clock or the time clock as a clock to be supplied via the change-over switch 111. Immediately after the crank fail flag is set, the tracking counter 109 (counter for generating angle clocks) is stopped, the clock for operating the angle counter 112 for ignition/injection is switched from the angle clock to the time clock, and the function of the angle counter 112 for ignition/injection is changed to a free-run counter of the time clock.

As shown in FIG. 2, the cam signal is the cylinder determination signal having trailing edges at 144* CA intervals. Consequently, a relative angle from the top dead center (TDC) of each cylinder to the trailing edge of the cam signal is known, and a relative angle from the trailing edge of the cam signal closest to requested energization start timing and requested ignition timing calculated by the CPU 11 can be obtained.

Figure 6:
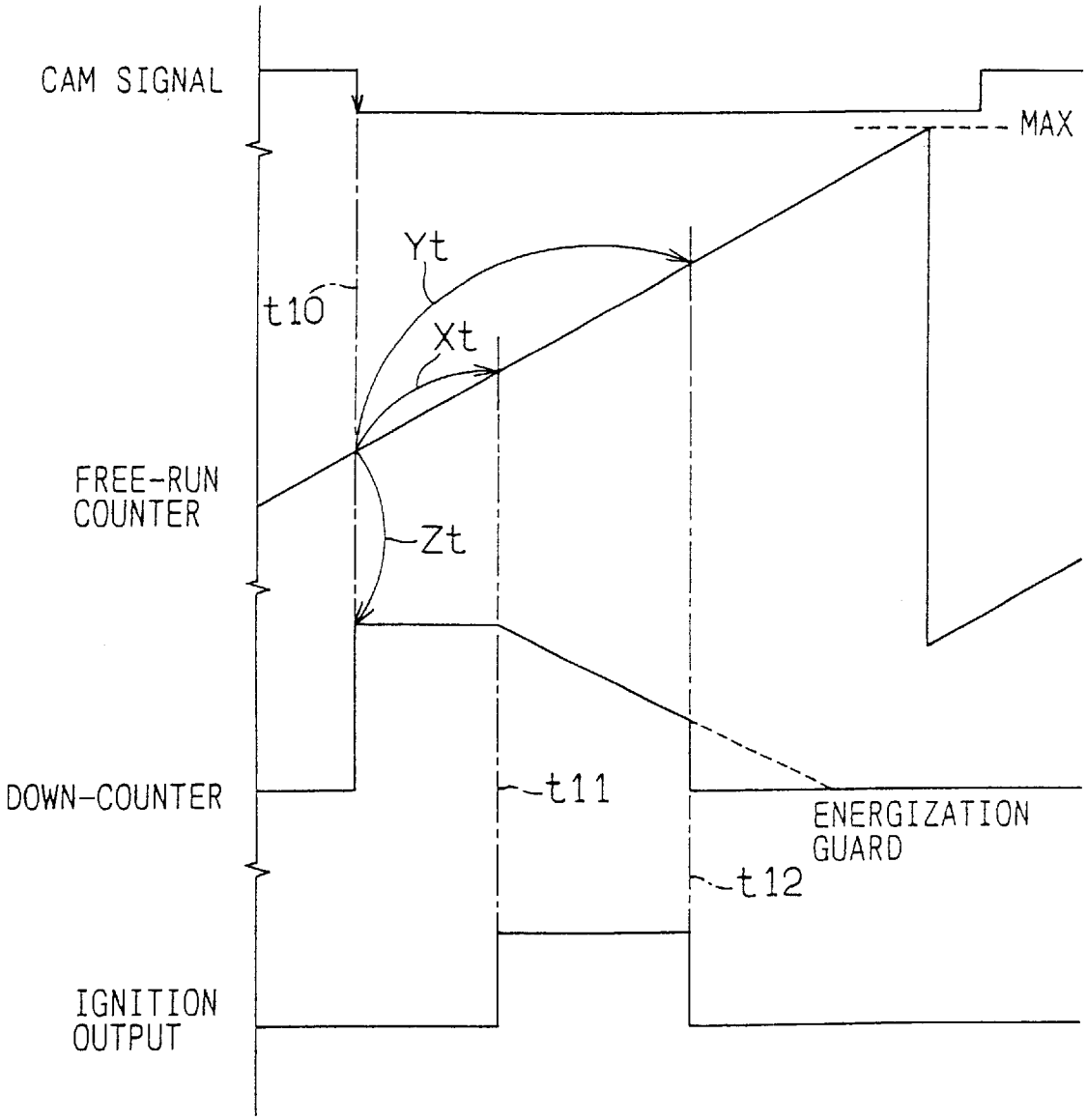
FIG. 6 is a time chart showing operations of a free-run counter and the down-counter in the embodiment.

As shown in FIG. 6, by a predetermined cam signal trailing edge interrupt at t10, present time+energization start timing (time), present time+ignition timing (time), and an energization guard value are set. Specifically, the energization start timing and ignition timing are converted from the angles to time from the reference position (the relative angle from the cam signal trailing edge is converted to time Xt and Yt). The time from the present time (energization start time and the ignition start time) is set in each of the energization start time setting register and the ignition start time setting register. Further, the energization guard value Zt is set. By the above operations, when the value of the free-run counter and that of the energization start time setting register coincide with each other at timing t11, the down-counter starts and the output port is turned on. Further, at timing t12, when the value of the free-run counter and the value of the ignition start time setting register coincide with each other, the down-counter is reset and the output port is turned off. As described above, even after detection of a failure in the crank signal system, by the coincidence of the timers, the down-counter is started or reset, thereby enabling the function of controlling the ignition/injection output to be maintained. When the value of the ignition start time is set to be larger than the energization guard value as shown in FIG. 6, by resetting of the down-counter to "0", the injection output is stopped.

Figure 7:
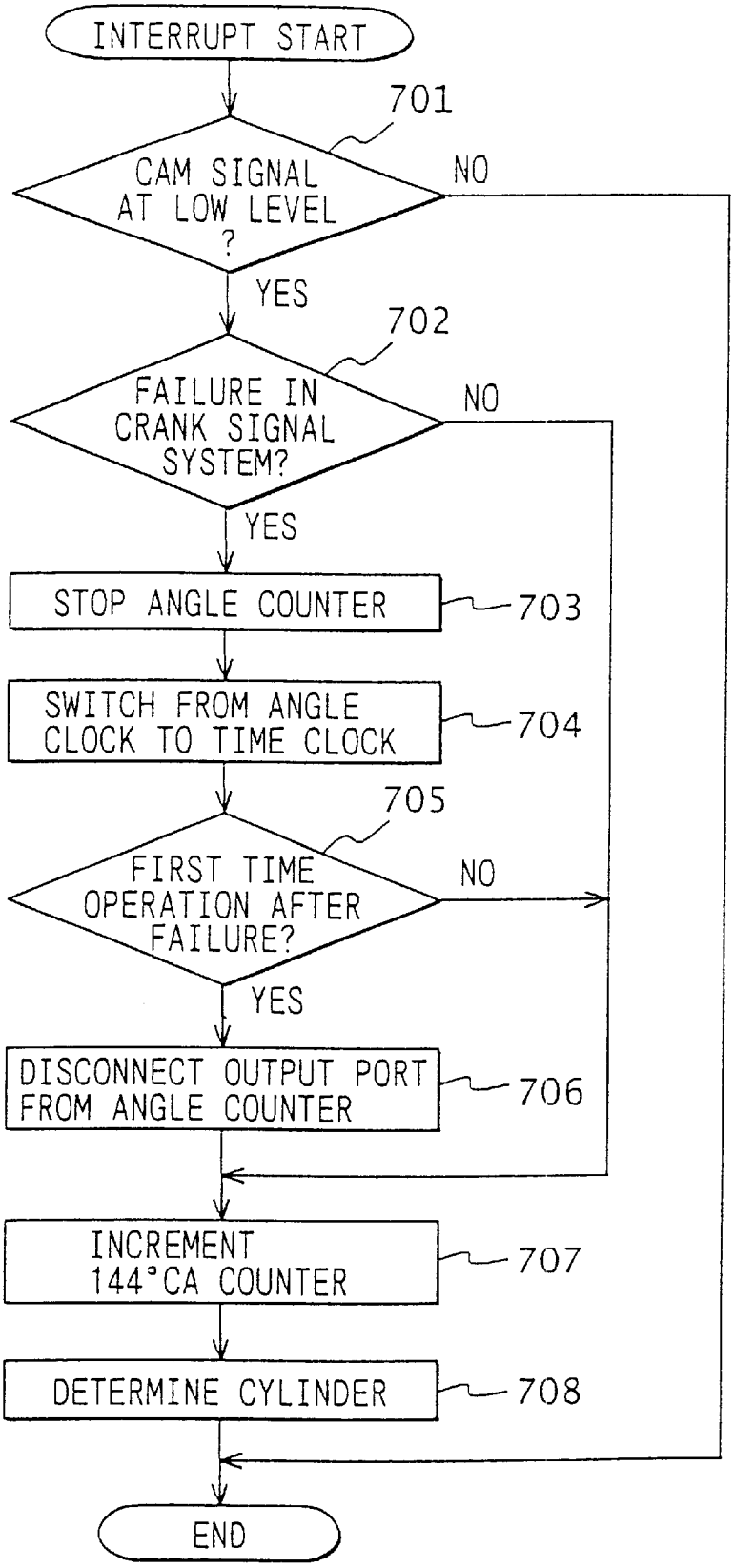
FIG. 7 is a flowchart showing processes performed when a failure in a crank signal system is detected by a cam signal trailing edge interrupt in the embodiment.
Figure 8:
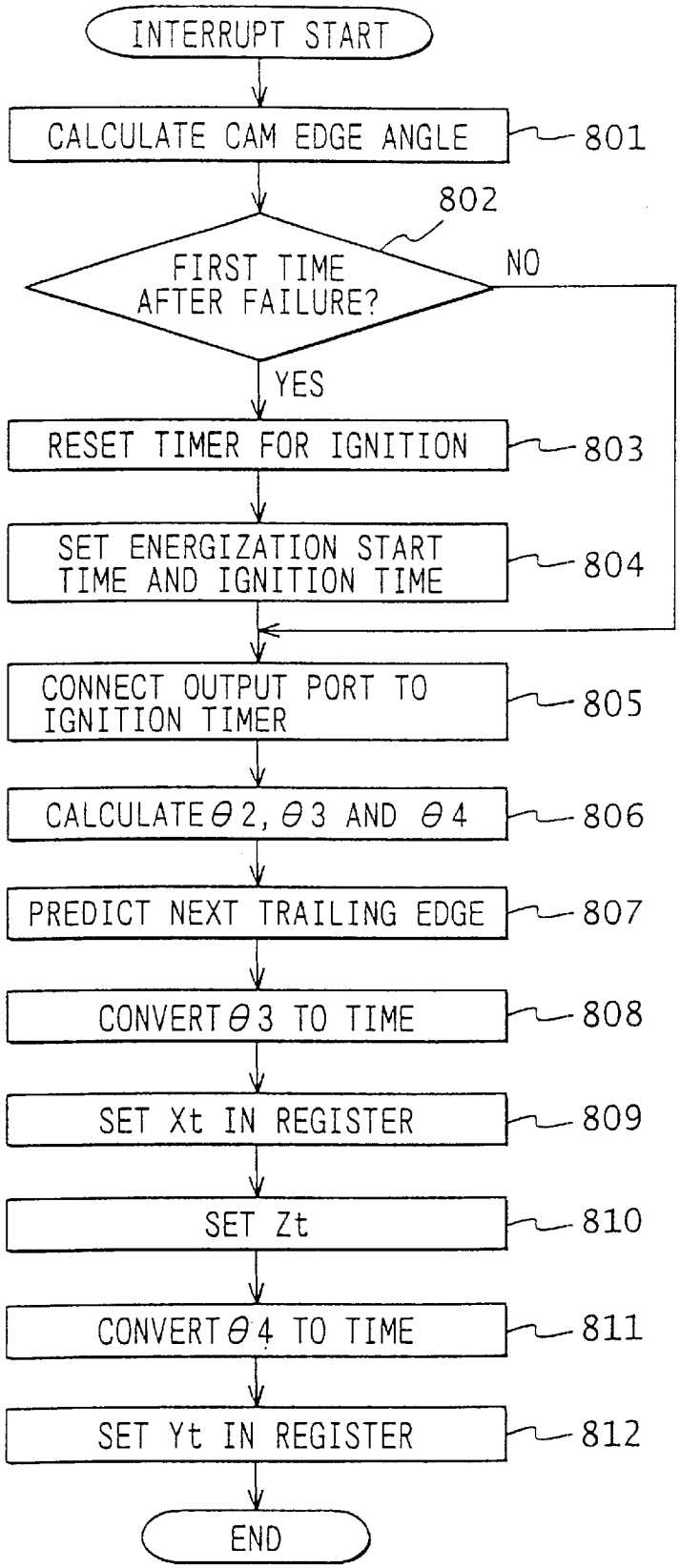
FIG. 8 is a flowchart showing an ignition output control process performed when a failure in the crank signal system is detected.

FIGS. 7 and 8 are flowcharts showing processes performed by the microcomputer 10 (particularly CPU 11) when a failure in the crank signal system is detected. FIG. 7 shows processes performed by the cam signal trailing edge interrupt when a failure in the crank signal system is detected.

Figure 9:
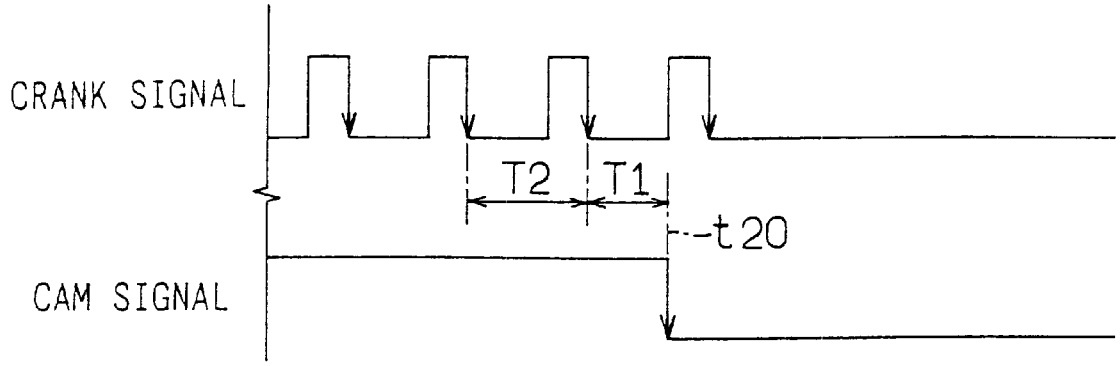
FIG. 9 is a time chart showing the crank signal and the cam signal in the case of failure of the crank signal system in the embodiment.

First, the CPU 11 determines whether the cam signal is at the low (L) level or high (H) level at step 701. In the case of the L level, a 144* CA cycle interrupt occurs. When the cam signal level is the L level, the CPU 11 determines a failure in the crank signal system at step 702. Specifically, as shown in FIG. 9, time T1 from the trailing edge of the cam signal (timing t20) to an immediately preceding crank edge input and time T2 from the crank edge input to an immediately preceding crank edge input are obtained. T1 and T2 are compared with each other. When T1 is much longer than T2, occurrence of a failure is determined. In the case of the failure, a process of stopping the function of the crank signal processing hardware is performed.

Further, at step 703 in FIG. 7, the CPU 11 initializes the tracking counter 109 for generating angle clocks. In order to stop the counting, the CPU 11 stops transmission of the reset signal from the tracking counter 109.

At step 704, the CPU 11 switches the change-over switch 111 in FIG. 3 to the position that the time clock is sent to the angle counter 112 for ignition/injection. By the operation, the angle counter 112 for ignition/injection is disconnected from the tracking counter 109, and the operation clock of the angle counter 112 for ignition/injection is changed from the angle clock to the time clock. Further, for the preparation of switching from the ignition by the crank signal in the hardware manner to the ignition performed by the cam signal trailing edge interrupt, at step 705, the CPU 11 determines whether or not the operation is performed for the first time after detection of the failure such as short circuit in the crank signal system. When it is the first time, at step 706, the connection between the angle counter 112 for ignition/injection and the output port is once interrupted. This is a process for preventing the ignition from being performed by an abnormal crank signal in a period during which the ignition function is switched (from the hardware-controlled counter to the free-run counter).

On the other hand, when the crank signal system is not abnormal at step 702, the CPU 11 advances its processing its processing to step 707 where the 144* CA cycle counter is incremented. That is, this counter is a counter which performs the counting operation at 144* CA cycles of the cam signal. Since the cam signal is a cylinder determination signal and has trailing edges which occur in the 144* CA cycles, the process of step 707 is to switch the ignition to the ignition performed by the cam signal trailing edge interrupt as soon as possible when a failure in the crank signal system is detected. The CPU 11 makes the cylinder determination from the cam signal (cylinder determination signal) at step 708. Specifically, for example, as shown by T100 and T200 by the cam edge at t30 in FIG. 2, by measuring the duration of the level of the cam signal, the cylinder determination is made. By making the cylinder determination in such a manner, when the crank signal is faulty, the ignition performed by the cam signal trailing edge interrupt can be immediately set at the trailing edge of the cam signal.

When the failure is detected, the CPU 11 advances its processing from step 706 to steps 707 and 708 where the 144* CA cycle counter is incremented and the cylinder determination is made.

Figure 10:
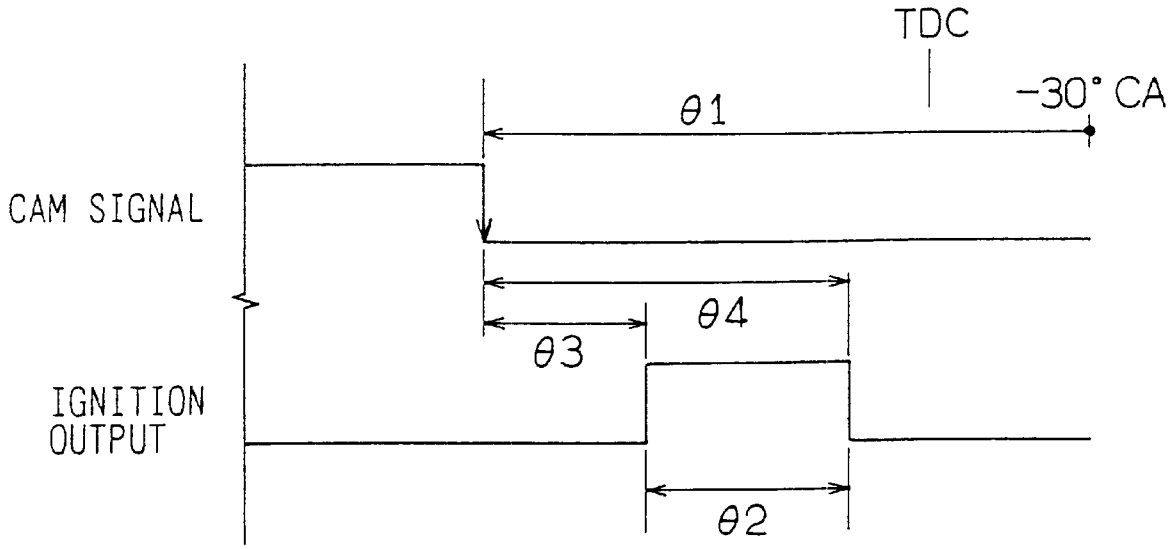
FIG. 10 is a time chart showing an ignition control performed when the failure in the crank signal system is detected.

FIG. 8 is a flowchart showing the ignition output control when a failure in the crank signal system is detected. After the crank signal system failure detecting process in FIG. 7 is performed at the trailing edge of the cam signal, the processes in FIG. 8 are performed. First, at step 801, the CPU 11 calculates the angle of the trailing edge of the cam signal from the most retard angle position of the ignition timing. Specifically, an angle θ1 (refer to FIG. 2) is obtained from −30* CA in FIG. 10. At step 802, the CPU 11 determines whether or not the process is performed for the first time after the failure such as short circuit in the crank signal system is detected. When it is the first time, at step 803, the free-run timer (timer for ignition) 112 is reset (initialized). Further, at step 804, the CPU 11 sets each of the values of the energization start time setting register and the ignition start time setting register to the maximum value (for example, FFFF in hexadecimal) which is the most different value from the timer initial value (=0) (refer to FIG. 6). By setting the energization start time and the ignition start time so as not to coincide with each other, erroneous ignition can be prevented.

At step 805, the CPU 11 connects the free-run timer (ignition timer) 112 to the output port which are interrupted at step 706 in FIG. 7 when the failure in the crank signal system is detected, thereby preparing the ignition output control, and the ignition output control is set at step 806 and subsequent steps. First, at step 806, the CPU 11 converts the requested energization time to an angle (θ2 in FIG. 10), and calculates relative angles from the trailing edge of the cam signal of the energization start timing and the ignition timing (θ3 and θ4 in FIG. 10).

At step 807, the CPU 11 predicts the time to the next trailing edge. At step 808, the CPU 11 converts the energization start timing θ3 to time on the basis of the predicted time. At step 809, the energization start time calculated at step 808 is added to the present time, and the resultant time is set in the energization start time setting register as shown in FIG. 6. In the set time from the present time, the timers coincide with each other, the ignition output port is turned on, and the actual energization is started. At step 810, the CPU 11 sets the energization guard value. At step 811, the CPU 11 converts the ignition timing (θ4 in FIG. 10) into time. At step 812, the ignition start time calculated at step 811 is added to the present time and the resultant time is set in the ignition start time setting register in FIG. 6. In the set time after the present time, the timers coincide with each other, the ignition output port is turned off to finish the energization, and the actual ignition is carried out.

In the system for turning on the ignition output port in a hardware manner when the angle timer and angle of the ignition/injection timing and the like coincide with each other, when a short circuit occurs in the crank signal system and the ignition/injection control cannot be performed by the angle timer (angle counter 112 for ignition/injection in FIG. 3), the angle timer itself which operates by the angle clocks is stopped to prevent erroneous ignition, and then the function is changed to the free-run counter which operates by the time clocks. The relative angle from the trailing edge of the cam signal in the ignition/injection timings is converted to time by using the cam signal as an angle reference signal. By time coincidence with the free-run counter obtained by changing the function of the angle timer, the hardware-controlled output function is used as it is. As a result, a limp-home function can be provided when a failure in the crank signal system occurs.

As described above, the embodiment has the following features.

(A) As shown in FIG. 3, the change-over switch 111 is provided at the front stage of the angle counter 112 for ignition/injection which operates on the basis of the frequency multiplication clocks. When the CPU 11 as failure detecting means and switching means detects a failure in the crank signal system, the change-over switch 111 is controlled to switch the angle counter 112 for ignition/injection so as to be used as a free-run counter which operates on the basis of time clocks. In accordance with the value of the counter, the CPU 11 generates a control signal (ignition signal) for controlling the engine. Even when a short circuit or the like occurs in the crank signal line or a pulse is missed in the crankshaft rotor, the ignition, injection and the like can be controlled accurately and the engine control can be normally continued. In the system for generating frequency multiplication signals at predetermined angle intervals to synchronize with the engine speed, even when a failure occurs in the crank signal system, the engine control can be continuously performed.

(B) When a failure in the crank signal system is detected, the signal supply line (angle clock supply line) based on the frequency multiplication signals in the counter 112 is disconnected by using the change-over switch 111 in FIG. 3. Consequently, noise can hardly enter the counter 112 via the angle clock supply line.

(C) When a failure in the crank signal system is detected by executing the process of step 706 in FIG. 7, the CPU 11 once interrupts the connection between the engine drive signal output port and the counter 112, so that an erroneous drive signal (ignition signal or the like) can be prevented from being outputted during the function of the counter 112 is being shifted.

Although the reference position in the crank signal is a pulse missing portion in the pulse train in the above description, it is not limited to the pulse missing portion. A reference position in which a pulse interval is not uniform may be provided in a pulse train of every predetermined angle interval in another structure (such as a structure in which a pulse is inserted in a pulse train).

The present invention should not be limited to the disclosed embodiment, but may be implemented in many other ways without departing from the spirit of the invention.

What is claimed is:

1. An engine control unit comprising:

pulse interval measuring means for receiving a crank signal of a pulse train of a predetermined angle interval corresponding to rotation of a crankshaft of an engine and measuring a pulse interval;

frequency multiplication signal generating means for generating frequency multiplication signals of an integer times a next pulse in accordance with the pulse interval measured by the pulse interval measuring means;

a counter which operates in accordance with the frequency multiplication signals;

failure detecting means for detecting a failure in a crank signal system which supplies the crank signal;

switching means for switching the counter so as to be used as a free-run counter which operates in accordance with time clocks when the failure in the crank signal system is detected by the failure detecting means; and means for generating a control signal for controlling the engine in accordance with a value of the counter.

2. The engine control unit as in claim 1, wherein:

a signal supply line for supplying the frequency multiplication signal to the counter is disconnected when the failure in the crank signal system is detected.

3. The engine control unit as in claim 1, wherein:

connection between an output port of an engine drive signal and the counter is once interrupted when the failure in the crank signal system is detected.

4. The engine control unit as in claim 1, wherein:

a signal specifying a cylinder position is used as a reference signal when the counter is used as the free-run counter which operates in accordance with time clocks.

5. An engine control unit comprising:

pulse interval measuring means for receiving a crank signal of a pulse train of a predetermined angle interval corresponding to rotation of a crankshaft of an engine and measuring a pulse interval;

time data storing means for storing time data calculated by dividing the measured pulse interval by a predetermined value;

angle clock generating means for generating angle clocks at an interval of the stored time data;

count processing means which operates in accordance with the angle clocks;

failure detecting means for detecting a failure in a crank signal system which supplies the crank signal;

time clock generating means for generating time clocks at an interval of a fixed time; and switching means for switching counting process of the count processing means from the angle clocks to the time clocks when the failure in the crank signal system is detected by the failure detecting means.

6. The engine control unit as in claim 5, wherein:

the switching means switches over a signal supply line to the count processing means for changing input to the count processing means from the angle clocks to the time clocks when the failure in the crank signal system is detected.

7. The engine control unit as in claim 5, wherein:

connection between an output port of an engine drive signal and the count processing means is once interrupted when the failure in the crank signal system is detected.

8. The engine control unit as in claim 5, wherein:

a signal specifying a cylinder position is used as a reference signal when an input to the count processing means is changed from the angle clocks to the time clocks.

9. The engine control unit as in claim 5, wherein:

the count processing means executes the counting process for determining a time point related to a fuel injection event for the engine.

10. The engine control unit as in claim 5, wherein:

the count processing means executes the counting process for determining a time point related to an ignition event for the engine.

* * * * *